US007351041B2

(12) United States Patent
Uselton et al.

(10) Patent No.: US 7,351,041 B2
(45) Date of Patent: Apr. 1, 2008

(54) FAN WITH REDUCED NOISE GENERATION

(75) Inventors: Robert B. Uselton, Plano, TX (US); Leonard J. Cook, Lewisville, TX (US); Terry Wright, Panama City Beach, FL (US)

(73) Assignee: Lennox Industries Inc., Richardson, TX (US)

( * ) Notice: Subject to any disclaimer, the term of this patent is extended or adjusted under 35 U.S.C. 154(b) by 190 days.

(21) Appl. No.: 11/055,469

(22) Filed: Feb. 10, 2005

(65) Prior Publication Data

US 2005/0147496 A1 Jul. 7, 2005

Related U.S. Application Data

(62) Division of application No. 09/994,294, filed on Nov. 26, 2001, now Pat. No. 6,872,048.

(51) Int. Cl.
*F04D 29/68* (2006.01)

(52) U.S. Cl. ..... 416/236 R; 416/DIG. 3; 415/119

(58) Field of Classification Search ..... 416/62, 416/235, 236 A, 237, DIG. 3, 236 R, 228; D23/413

See application file for complete search history.

(56) References Cited

U.S. PATENT DOCUMENTS

| | | | | |
|---|---|---|---|---|
| 1,022,203 | A | | 4/1912 | Nettle |
| 1,135,829 | A | | 4/1915 | Macdonald |
| 1,531,967 | A | | 3/1925 | Macmillan |
| 2,238,749 | A | | 4/1941 | Peltier |
| 3,578,264 | A | | 5/1971 | Kuethe |
| 3,937,594 | A | | 2/1976 | Ito et al. |
| 4,859,150 | A | * | 8/1989 | Takigawa ..... 415/119 |
| 5,169,290 | A | | 12/1992 | Chou |
| 5,540,406 | A | | 7/1996 | Occhipinti |
| 5,601,410 | A | * | 2/1997 | Quinlan ..... 415/119 |
| 5,603,607 | A | | 2/1997 | Kondo et al. |
| 5,871,174 | A | | 2/1999 | Hannay |
| 6,004,095 | A | | 12/1999 | Waitz et al. |

OTHER PUBLICATIONS

Watson, J.M., To Move Air—Equations Find The Right Impeller, Product Engineering, Jan. 9, 1961.
Richards, E. J., et al., Noise and Acoustic Fatigue In Aeronautics, pp. 215-240, John Wiley & Sons Ltd., 1968.
Wright, Terry, et al., Blade Sweep for Low Speed Axial Fans, 89 GI-53, American Society of Mechanical Engineers, Jun. 4, 1989.

(Continued)

*Primary Examiner*—Richard A. Edgar
(74) *Attorney, Agent, or Firm*—W. Kirk McCord

(57) ABSTRACT

Axial flow fan propellers are provided with a roughened portion along the trailing edge of the fan blades on the pressure side of the blade to minimize tonal acoustic emissions generated by laminar boundary layer vortex shedding. The roughened portion may be provided by trip surfaces formed in the blades, by strips of abrasive material adhered to the blades along the trailing edges, respectively, by parallel or cross-hatched serrations in the blades or by upturned or offset trailing edges of the blades. The height of the roughened portion should be about equal to the boundary layer thickness of air flowing over the blade surfaces during operation of the fan. The fan propellers are particularly advantageous in heat exchanger applications, such as residential air conditioning system condenser units.

1 Claim, 5 Drawing Sheets

OTHER PUBLICATIONS

Van Der Spek, Hank F., Reduction of Noise Generation by Cooling Fans, TP 93-03, Cooling Tower Institute, Feb. 17, 1993.
Agboola, Femi, et al., The Acoustic Properties of Low Speed Axial Fans With Swept Blades, NCA—vol. 21, 1995 IMECE, American Society of Mechanical Engineers, 1995.
Baade, Peter K., Vibration Control of Propeller Fans, Sound and Vibration, pp. 16-26, Jul. 1998.
Agboola, Femi A., et al., The Effects of Axial Fan Noise Control by Blade Sweep On The Radical Component of Velocity, AIAA-99-2862, Copyright 1998 by the authors, American Institute of Aeronautics and Astronautics, May 10, 1999.

* cited by examiner

FAN WITH REDUCED NOISE GENERATION

CROSS REFERENCE TO RELATED APPLICATION

This application is a division of application Ser. No. 09/994,294, filed Nov. 26, 2001, now U.S. Pat. 6,872,048 B2.

BACKGROUND

Fan noise has been identified as a primary component of overall noise generated by various types of machinery, including heat exchanger equipment. For example, low speed, low pressure axial flow fans are typically used in heat exchanger applications, such as for moving ambient air over commercial and residential air conditioning condenser heat exchangers. In residential air conditioning systems, low speed, low pressure axial flow fans typically meet the requirements for effective operation in terms of performance capability, durability, and cost.

Although relatively low speed, low pressure axial flow fans have achieved noticeable reduction in noise generation through the design of the fan blading and reductions in turbulence from motor supports and fan shrouding, many of such fans continue to generate noise at frequencies which are perceived by the human ear as somewhat annoying. Moreover, the application of axial flow, low speed, low pressure fans in residential air conditioning systems, where relatively high density dwellings result in a condenser unit for one residence being within a few feet of an adjacent residence, has mandated further reductions in noise generated by air conditioning condenser cooling fans, in particular.

Fan self induced tonal noise in a frequency range of about 2300-3500 Hz has been identified during operation of low speed, low pressure, axial flow fans. Reduction of noise in this frequency range as well as over a relatively broad range of frequencies normally audible to humans is always sought. One source of noise in axial flow fans, in particular, is due to a phenomenon known as laminar boundary layer shedding. This phenomenon is similar in some respects to the generation of the well-known von Karman vortex streets which occur when fluid flows around a body disposed in the fluid flow path. In accordance with the present invention, tonal noise generated by laminar boundary layer shedding has been measurably decreased thereby providing advantages in fans used in various air-moving applications and, particularly, in applications associated with heat exchange equipment in air conditioning systems and the like.

SUMMARY OF THE INVENTION

The present invention provides an air-moving fan having reduced acoustic emissions or "noise" perceptible to the human ear.

The present invention also provides an improved heat exchanger unit including an axial flow low speed, low pressure fan having reduced noise generation and being generally of the type used in applications, such as commercial or residential air conditioning unit condenser units.

In accordance with one aspect of the present invention, generally axial flow type fan propellers are provided with roughness on the fan blade surfaces on the so-called pressure side of the blades adjacent the trailing edges of the blades, which roughness disrupts the boundary layer shedding phenomena and also reduces tonal noise generated by the fan blade in a frequency range perceptible to human hearing. The roughness is placed on the pressure side or surface of the blade, which is the surface substantially facing the general direction of air movement discharged from the fan, adjacent the blade trailing edge and preferably extends over a major portion of the trailing edge between the radially outermost part of the blade and the fan hub. The roughness may take various forms, such as that created by relatively sharp edged curbs or trip surfaces or other portions of the blade forming a surface interruption or discontinuity, or a strip of abrasive paper or cloth, such as so-called sandpaper, suitably secured to the blade surfaces. The height of the roughness is preferably at least that of the thickness of the boundary layer of the air moving over the blade surface.

Still further, the blade surface roughness may be generated by plural ridges extending generally parallel to the contour of the blade trailing edge or by a so-called cross-hatched or gridlike arrangement of ridges similar to the geometry of knurled surfaces. It is contemplated that the blade surface roughness may also be provided by upturning or offsetting the trailing edge of the blade to also provide a curb or trip surface extending somewhat normal to a major portion of the blade surface.

Although the reduction in noise generation is deemed to be particularly noticeable for fan propellers with forward-swept blades, it is contemplated that the invention may be applied to propellers with substantially straight, radially projecting blades as well as backward-swept blades. The present invention also contemplates that fans having blades of other configurations may benefit from the provision of "roughened" trailing edge portions which are operable to disrupt laminar boundary layer shedding.

Those skilled in the art will further appreciate the above-mentioned advantages and superior features of the invention together with other important aspects thereof upon reading the detailed description which follows in conjunction with the drawings.

DETAILED DESCRIPTION OF THE PREFERRED EMBODIMENTS

Figure 1:
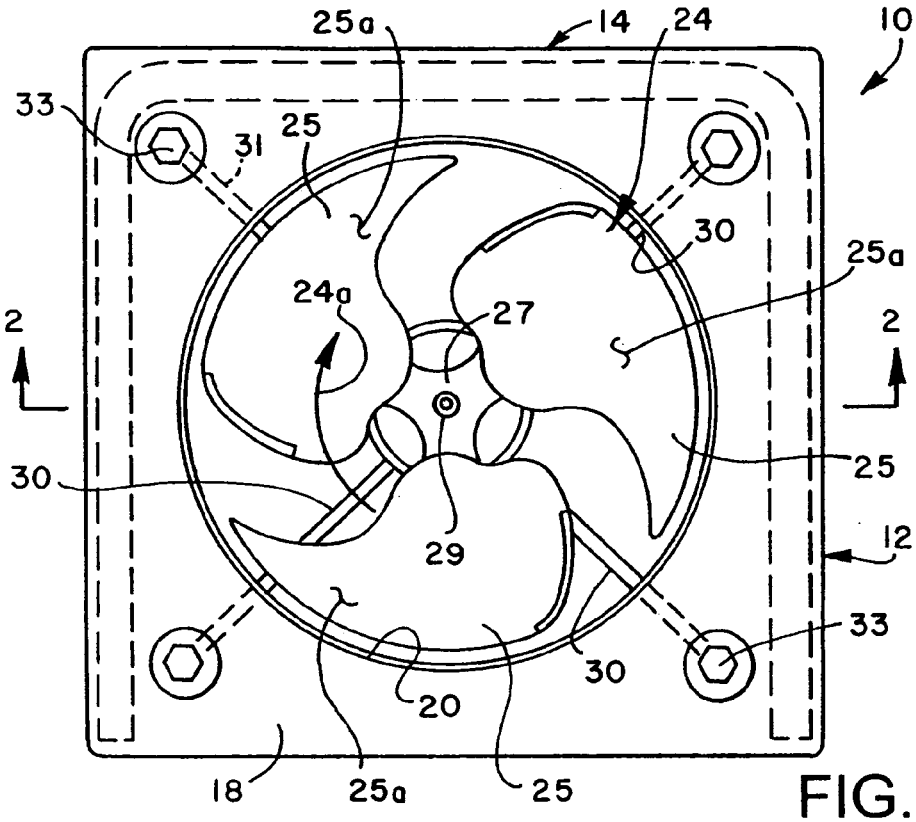
FIG. 1 is a top plan view of a heat exchanger in the form of an air conditioning condenser unit including one embodiment of an improved, generally axial flow fan propeller in accordance with the invention.

In the description which follows, like parts are marked throughout the specification and drawing with the same reference numerals, respectively. The drawing figures are not necessarily to scale and certain features may be shown in somewhat generalized or schematic form in the interest of clarity and conciseness.

Figure 2:
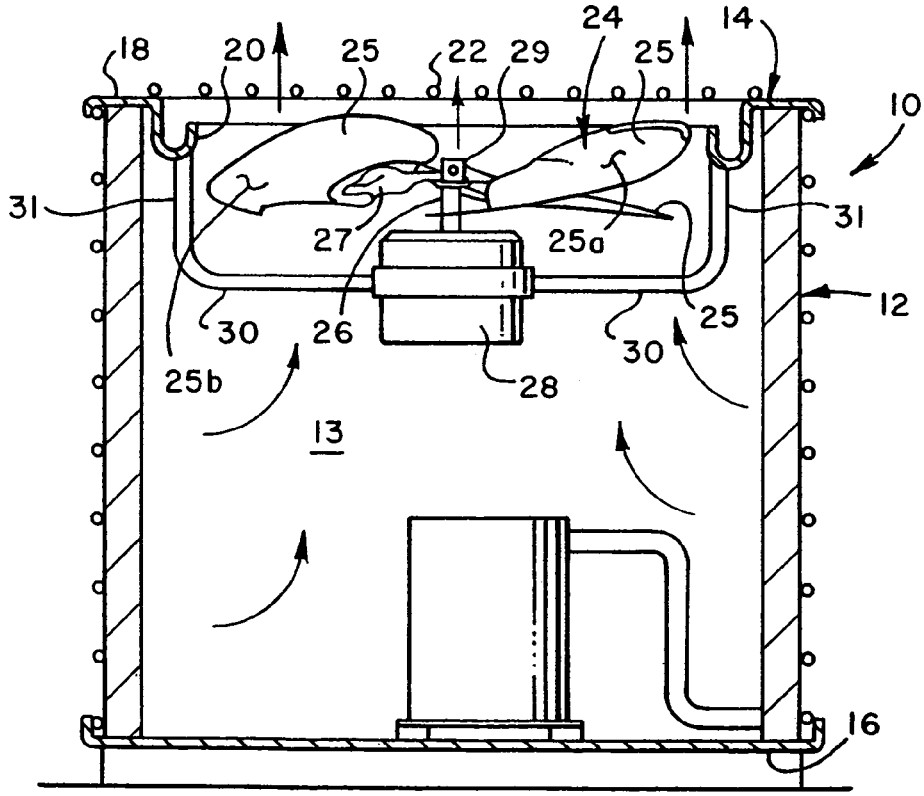
FIG. 2 is a section view taken generally along the line 2-2 of FIG. 1.

Referring to FIGS. 1 and 2, there is illustrated an improved apparatus in accordance with the invention utilizing an improved low noise, axial flow propeller type fan in accordance with the invention, said apparatus being generally designated by the numeral 10. The apparatus 10 is characterized, by way of example, as a condenser type heat exchanger unit for a residential air conditioning system including a generally U-shaped, or partially wraparound, tube and fin heat exchanger or condenser 12 mounted within a generally rectangular cabinet 14. Cabinet 14 includes a plate-like base 16 and a generally planar or plate-like shroud 18 having a cylindrical fan discharge opening 20 formed therein. A suitable grille 22 is preferably disposed over the opening 20, as shown.

Mounted partially within the opening 20 is an axial flow fan of the multiblade propeller type, generally designated by the numeral 24 and which is mounted for rotation on and with a shaft 26, FIG. 2, comprising the output shaft of a conventional electric motor 28. Motor 28 is mounted on a support structure including four relatively thin, circumferentially spaced apart, generally radially projecting rods 30, the distal ends of which are upturned, as indicated at 31 in FIG. 2, and suitably configured for support by the shroud 18 by conventional fasteners 33, FIG. 1.

The fan propeller 24 is shown by way of example as a three-bladed member having respective forward-swept circumferentially spaced blades 25 which are suitably mounted on a hub 27. Hub 27 has a suitable core part 29 which is mounted directly on shaft 26. The configuration of the fan propeller 24 as shown in FIGS. 1 and 2 is such that the direction of rotation is indicated by the arrow 24*a* in FIG. 1. This direction of rotation results in air being drawn through the heat exchanger or condenser 12 into the interior space 13, FIG. 2, of the cabinet 14 and discharged through the opening 20 generally vertically upward, as indicated by the unnumbered arrows in FIG. 2. Accordingly, as shown in FIG. 2, the upper or pressure side of each blade 25 facing substantially the general direction of air flow discharged from the fan propeller 24 is designated by numeral 25*a* while the opposite or suction side of each blade 25 is designated by numeral 25*b*.

Figure 3:
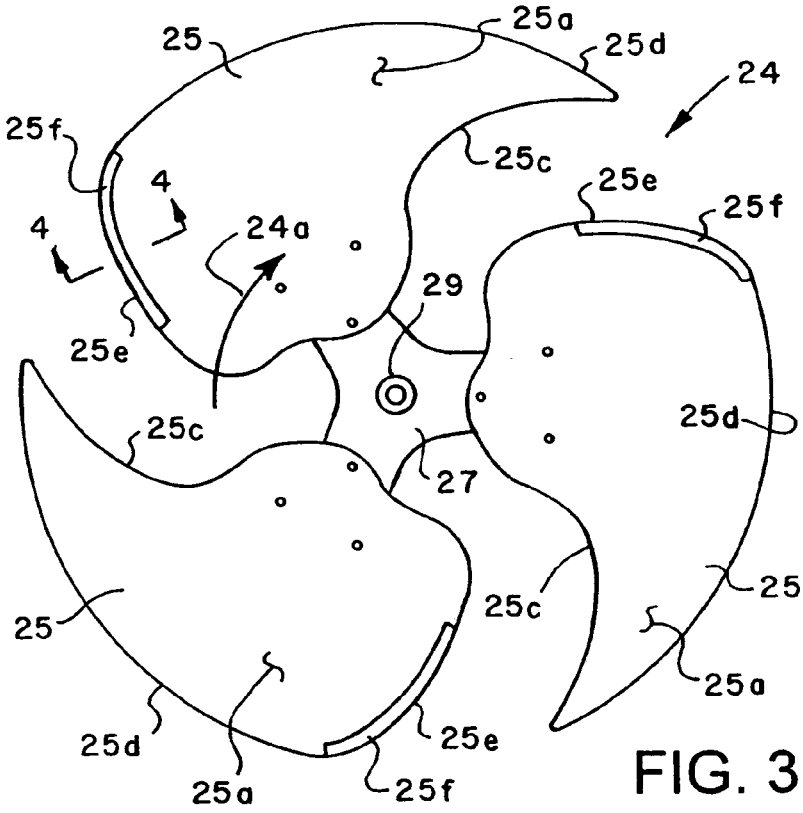
FIG. 3 is a top plan view of the fan propeller shown in FIGS. 1 and 2.

Referring now to FIG. 3, the fan propeller 24 is shown in a top plan view on a larger scale. Each of the blades 25 includes a forwardly swept leading edge 25*c*, a peripheral rim 25*d* and a trailing edge 25*e*. The surface 25*a* of each blade 25 is "roughened" along and adjacent at least a portion of trailing edge 25*e*, as indicated at 25*f* in FIG. 3. Roughened surface 25*f* preferably extends from peripheral rim 25*d* along a major portion of trailing edge 25*e* of each blade 25. The width of the roughened surface 25*f* may be selected in accordance with a procedure to be described further herein.

Figure 4:
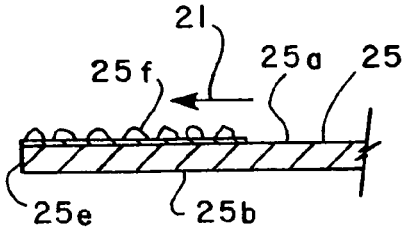
FIG. 4 is a detail section view of one of the blades of the fan propeller taken along the line 4-4 of FIG. 3 and showing one preferred embodiment of blade surface roughness.
Figure 5:
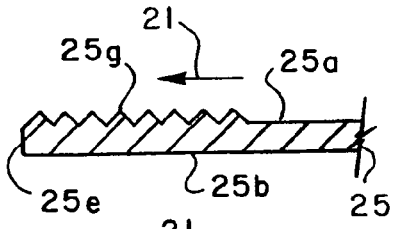
FIG. 5 is a detail view similar to FIG. 4 showing a first alternate embodiment of roughness provided on the trailing edge of the fan blade.

The characteristics of the roughness or roughened surfaces 25*f* on the so-called pressure sides 25*a* of blades 25 may be varied. As shown in FIG. 4, the roughened surface 25*f* may comprise a strip of abrasive paper adhered to the surface 25*a*. of each blade 25 and extending along and directly adjacent a major portion of trailing edge 25*e*. For example, abrasive paper or so-called sandpaper having a grit size of about 120 has been found to be suitable. However, it is contemplated that the so-called roughened blade surface may also be formed as shown in FIG. 5 wherein a series of spaced apart ridges 25*g*, extend generally parallel to each other and to the trailing edge 25*e*. Ridges 25*g* may be formed on the blade surface 25*a* and extending inward from the trailing edge 25*e* approximately the same distance as the roughened surface 25*f*.

Figure 7:
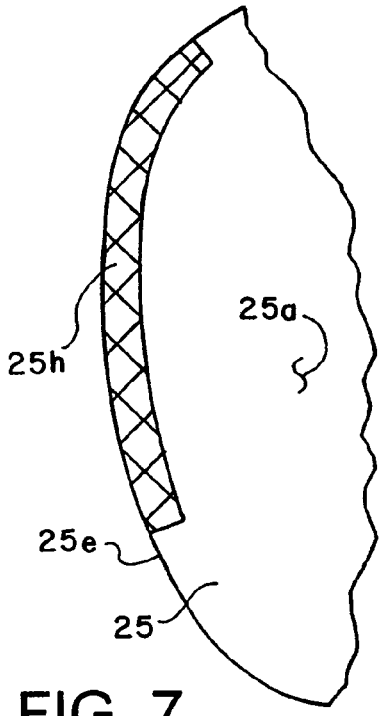
FIG. 7 is a detail plan view of a third alternate embodiment of roughness provided on the trailing edge of a fan blade for a fan propeller like that shown in FIGS. 1 through 3.

The so-called roughened surfaces of each blade 25 may also be formed as an area of cross-hatched serrations similar in some respects to what is known as a knurled surface, and as indicated by the roughened surface 25*h* shown in FIG. 7.

Figure 6:
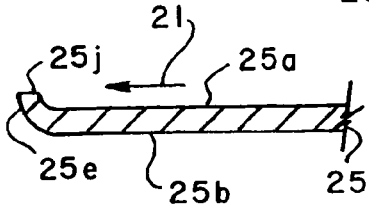
FIG. 6 is a detail view similar to FIGS. 4 and 5 showing a second alternate embodiment of roughness formed on the trailing edge of a fan blade.

Still further, the roughened surface or boundary layer trip may be formed by merely curling or bending the trailing edge 25*e* upward away from and generally normal to the surface 25*a*, as indicated at 25*j* in FIG. 6.

Figure 8:
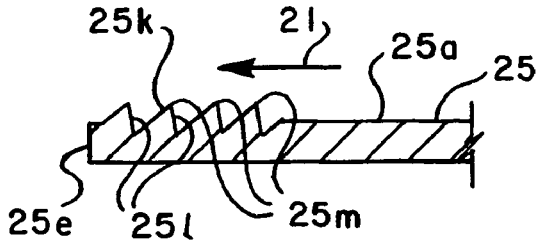
FIG. 8 is a detail section view taken along the same line as the view of FIG. 4 showing a fourth alternate embodiment of roughness for a fan blade of the type shown in FIG. 3.

Referring now to FIG. 8, another embodiment of a modified fan propeller blade 25 is illustrated wherein a roughened surface portion 25*k* is characterized by parallel spaced apart projections, trips or curbs which extend along the trailing edge 25*e*. The roughened surface 25*k* is characterized by a series of generally parallel grooves 25*l* and corresponding raised edges 25*m* which may be formed by a process known as skiving. The roughened surface 25*k* is similar in some respects to the roughened surface 25*g*. The skiving process provides for alternate grooves 25*l* and upturned relatively sharp edges 25*m* as indicated in FIG. 8.

Figure 9:
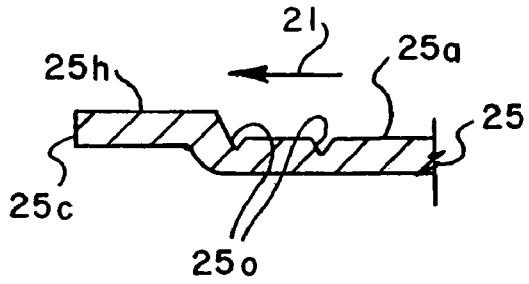
FIG. 9 is a detail view taken along the same line as that of FIG. 4 showing a fifth alternate embodiment of fan blade surface roughness or discontinuity.

Referring now to FIG. 9, still another embodiment of a surface interruption or discontinuity or so-called roughness may be provided on each of the blades 25 adjacent the respective trailing edge 25*e* and extending therealong by actually displacing or offsetting a portion of the blade adjacent the trailing edge 25*e*, as indicated at 25*n* in FIG. 9. The displacement of the blade 25 at 25*n* provides a surface interruption or discontinuity for surface 25*a* which extends generally normal to that surface as shown by the illustration of FIG. 9. A series of generally parallel grooves 25*o* may also be provided in the surface 25*a* as indicated in FIG. 9. As many as two to five grooves 25*o* made may be provided generally spaced apart and parallel to each other. However, by displacing the trailing edge of the blade 25*e* in a direction generally normal to the surface 25*a* as indicated at 25*n* by an amount approximately equal to the boundary layer thickness, a sufficient surface interruption is provided to reduce or eliminate the laminar boundary layer vortex shedding phenomena.

Figure 10:
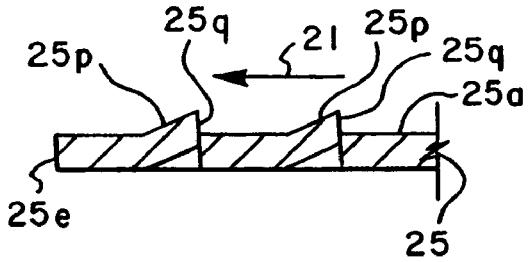
FIG. 10 is a detail section view taken along the line 10-10 of FIG. 11 and showing a sixth alternate embodiment of surface roughness for a fan blade of the fan propeller shown in FIG. 3.
Figure 11:
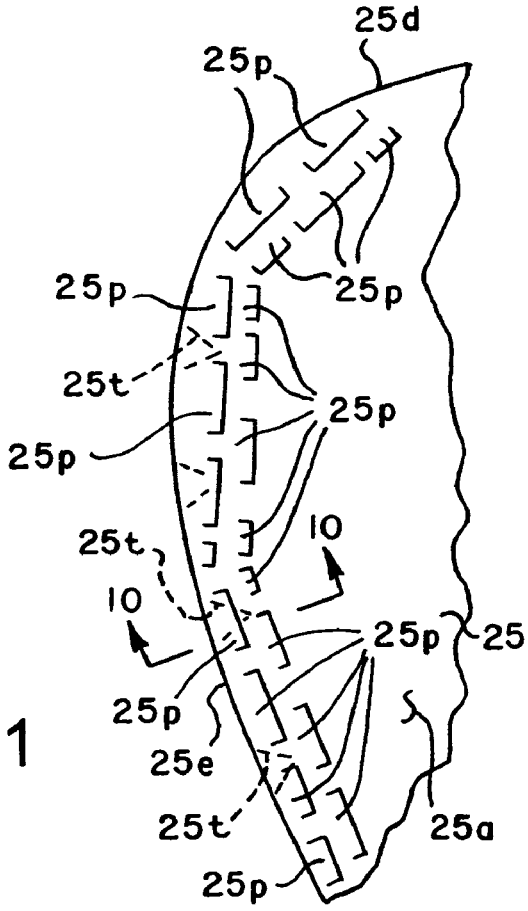
FIG. 11 is a detail plan view illustrating one preferred pattern of boundary layer trips or "roughness" for the embodiment of FIGS. 10 and 11.

Referring still further to FIGS. 10 and 11, yet another embodiment of a modified fan propeller blade 25 is illustrated wherein a series of parallel sharp edged trips 25*p* is provided by a suitable coining, stamping, punching or similar manufacturing process which provides surfaces 25*q* projecting generally normal to the blade surface 25*a* and forming a discontinuity or interruption in that surface. The roughened portions or trips 25*p* may be staggered along the trailing edge 25*e*, as indicated in FIG. 11. Two rows of staggered trips 25*p* of different lengths and overlapping gaps between the trips of an adjacent row are shown in FIG. 11.

Each of the roughened surface portions formed at or by elements 25*f*, 25*g*, 25*h*, 25*j*, 25*m*, 25*n* and 25*p* is formed such as to interrupt a generally laminar boundary layer of air flowing over the surface 25*a* of each of the blades 25 so as to prevent so-called laminar vortex shedding from the trailing edges of the blades.

EXAMPLE 1

A twenty-four inch diameter air conditioning system condenser cooling fan operating at 847 rpm to 859 rpm and having a geometry of the fan propeller 24 was tested with and without the roughened surface 25*f*. The blades 25 were of aluminum and of about 0.040 inch to 0.050 inch thickness. By applying a 0.375 inch width strip of 120 grit sandpaper of about 4.0 inches length to the blade surface 25*a* of each blade 25 directly adjacent the blade trailing edge 25*e*, a reduction in sound pressure level was observed within the human audible acoustic frequency range from about 200 Hz to 10,000 Hz. In particular, a bulge in the acoustic vibration one-third octave spectrum of the fan between 2400 Hz and 3150 Hz and a characteristic hissing sound generated thereby, was eliminated by a roughened blade surface treatment as described above. Accordingly, it is indicated that using surface roughness to force transition of fan blade surface air flows from laminar-to-turbulent flow may be achieved without significant modification to blade geometry and without any significant effect on fan propeller performance. It is noted that the highest frequency and sound power contribution of laminar flow shedding occurs at the highest speed portion of the fan blade.

EXAMPLE 2

A condenser cooling fan having generally the same geometry as the fan described above for Example 1 was tested over the same operating speed range. Each blade was provided with two rows of trips 25*p* and extending along the trailing edges 25*e* of the blades 25, respectively, and as shown in FIG. 11. The trips 25*p* had a height of about 0.039 inches from surface 25*a* with gaps between adjacent trips in a row of about 0.13 inches to preserve blade structural integrity. Starting with the radially outermost set of trips 25*p*, the two rows of trips of each set were arranged in the pattern shown in FIG. 11 extending over distances of about 1.3 inches, 2.3 inches and 2.3 inches, respectively.

Figure 12:
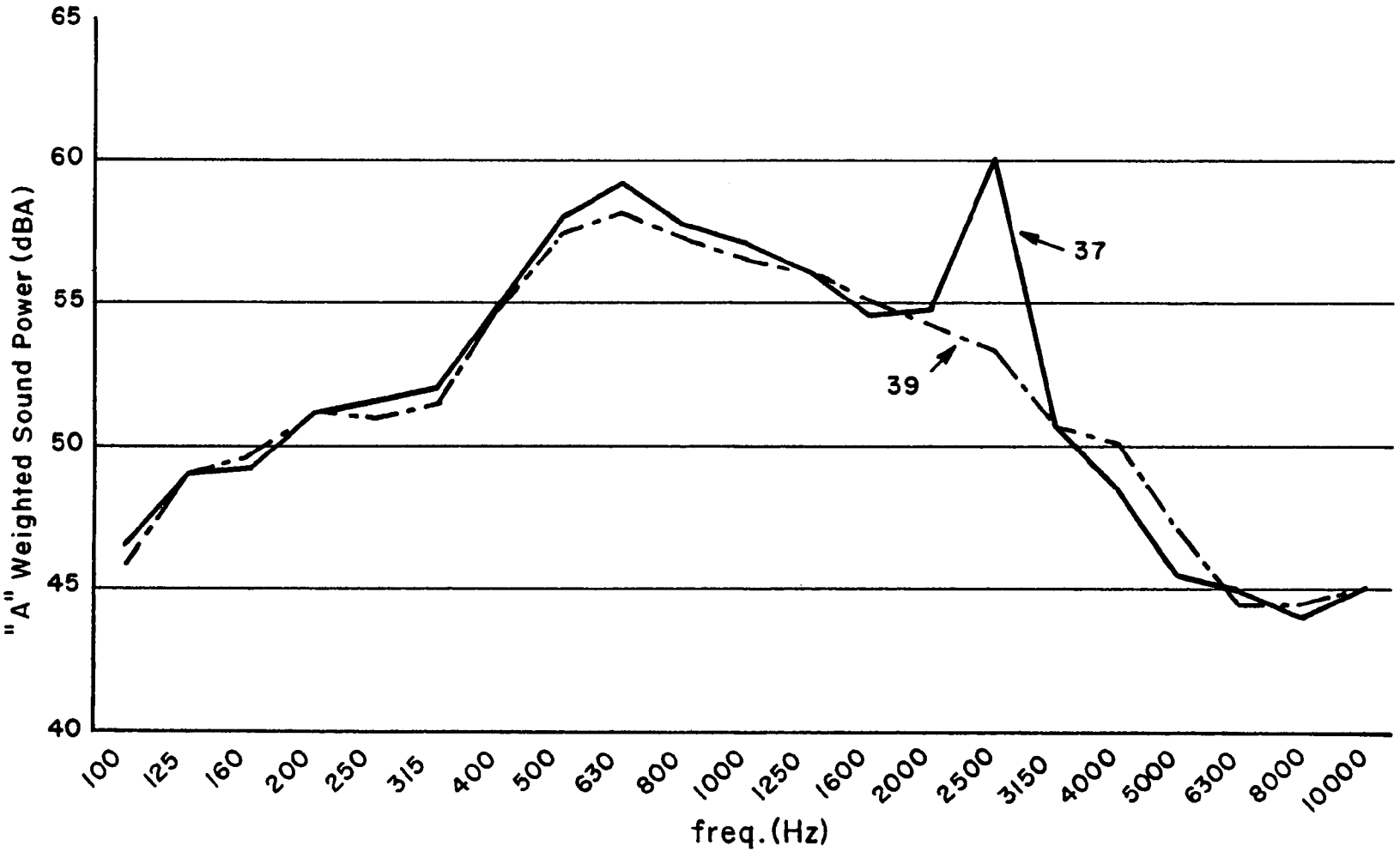
FIG. 12 is a diagram showing frequency versus sound power level for a fan as shown in FIG. 3 without any blade surface roughness and where surface roughness of the embodiment of FIGS. 10 and 11 has been added to the blades.

FIG. 12 illustrates the "A" weighted sound power level in dBA versus frequency in Hz (Hertz) for a fan having blades 25 without any surface interruption as indicated by the solid line curve 37. A maximum sound power level of about 60 dBA is indicated to occur at about 2800 Hz. As shown by the dashed line curve 39 in FIG. 12, a substantial reduction in noise generated in the range of about 2000 Hz to 3150 Hz was accomplished by providing the fan blades 25 with trips 25*p* as described above and shown in FIGS. 10 and 11 on a propeller with blades otherwise identical to the unroughened blades.

Referring again briefly to FIG. 11, there is illustrated an embodiment of the invention which eliminated the tonal noise in the above-mentioned frequency range of about 2000 Hz to 3150 Hz wherein a plurality of somewhat "V" shaped notches 25*t* were cut into the trailing edge 25*e* of each of the blades 25 of a fan having no other surface treatment on the blades, but being otherwise like the fan propeller 24. The V shaped notches 25*t* did eliminate the tonal noise in the frequency range indicated as a peak in FIG. 12. However, higher frequency broadband noise was notably increased, so the notches 25*t* were not deemed to be a good solution for tonal noise reduction desired for a fan propeller, such as the fan propeller 24.

One preferred way to characterize the height of roughness or boundary layer trip elements on the surface of a fan blade which are intended to generate a level of turbulence in the fluid boundary layer sufficient to destroy the coherence and flow pattern of naturally laminar flow is as follows.

Define the "roughness" or height of the disruption or discontinuity of the blade surface as $\epsilon$ and normalize the value by some physical reference dimension on the blade surface. The blade chord distance may be used to normalize E where C is the distance from the blade leading edge to its trailing edge in the peripheral or rotating direction along the blade. Normalized roughness is, then: $\epsilon/C$ Also needed is a characteristic measure of the boundary layer flow to be disrupted with the presence of roughness elements on the blade surface. This dimension is properly the thickness of the boundary layer, readily associated with the classical displacement thickness or the momentum thickness of the laminar layer. The choice is not very critical since they are all related.

Displacement thickness may be defined as $\delta^*$, and normalized as before as: $\delta^*/c$ On the blade surface the thickness of the laminar boundary layer is a function of the Reynolds number for the blade and the chord-wise position on the blade, defined by X or normalized as X/C that is being considered. It is also a function of the chord-wise pressure gradient along the blade, which may be defined as dp/dX.

Considering blades for which the boundary layer on the suction surface is laminar, in order to restrict attention to blades for which laminar vortex shedding can occur at the blade trailing edge, the analysis is restricted to flow conditions when dp/dX is small enough to allow the continuation of natural laminar flow to the blade trailing edge. To that end, it may be assumed that $dp/DX \approx 0$. This assumption allows use, with acceptable accuracy, of the flat plate boundary layer formula, where $$\delta^*/X = 1.721/Re_x^{1/2}$$

where the Reynolds number is $$Re_x = \rho VX/\mu = VX/\nu$$

where $\nu = \mu/\rho$

The traditional 99% boundary layer thickness is given by $\delta/X = 5.0/Re_x^{1/2}$ or $\delta/\delta^* \approx 3$. Here, $\rho$ and $\mu$ are the fluid properties of density and viscosity and V is the air velocity onto the blade, approximately equal to the rotating speed, $U = (r/R)ND/2$. r/R is the normalized radial station being examined, clearly lying between 0 and 1.0 R=D/2.

These formulas may be used for sizing the roughness height to be placed on the blade, by requiring that the height $\epsilon$ be of the order of the thickness $\delta^*$, or $\epsilon/\delta^* \approx 1$.

The frequency of vortex shedding from a blade that has not been sufficiently roughened is characterized by a Strouhal number of approximately $S_t \approx 0.21$. The value of $S_t$ is only weakly dependent on the value of $Re_x$, so that:

$$S_t = \omega d/2\pi U \approx 0.21 = fd/U$$

Here, $f=\omega/2\pi$, $U \approx ND/2$ and d is the diameter of a cylinder immersed in a laminar flow field; the classic Strouhal experiment, later theoretically explained by T. von Karman. It can be estimated that d is the order of the displacement thickness plus blade thickness, t. Thus one can calculate: $f \approx 0.21(U/d) = 0.21(U/(\delta^*+t))$ Typical values for fan blades of the type described herein are: blade thickness, t=0.040 inches, X=19 inches=1.6 ft, U=88 ft/s, $\nu=\mu/\rho-1.6\times10^{-4}$ ft$^2$/s which gives an $Re_x \approx 10^6$. Then $\delta^*/X \approx 0.017$ and $\delta^* \approx 0.0027$ ft=0.035". So with $d=\delta^*+t$, then f=2956 Hz. This is reasonable agreement with experimental results.

The criterion for turbulent flow at relatively low Reynolds number is that the pressure gradient on the suction surface of the blade be "sufficiently adverse." Hence, it is required that the "diffusion" on the suction surface be small enough to allow laminar flow to exist on the blades.

The turbomachinery value of diffusion can be described as $D_p=1-V_2/V_p$ or one minus the inverse of the ratio of the peak surface velocity to the value of velocity as the flow exits the blade row. These velocities can be described as functions of rotating speed, flow rate and pressure rise for the fan.

The value of $V_p$ is defined as $$V_p=[(xV_T)^2+V_a^2]^{1/2}+V_g$$

Where x=r/R, $V_T$ is the fan tip speed and $V_g=V_\theta/2$ is the "circulation velocity" related to pressure rise. Rewriting, $$V_p=V_T[x^2+\Phi^2)^{1/2}+\psi_T/(4\sigma x\eta_T)]$$

Similarly $V_2 \approx V_T-V_\theta$ and can be written as $$V_2=V_T[1-\psi_T/(2\sigma x\eta_T)]$$

In these forms, the flow coefficient, $\Phi$ is $$\Phi=V_2/V_T=Q/AV_T$$

and the pressure coefficient, $\psi_T$ is $$\psi_T=\Delta p_T/(\rho V_T^2/2)$$

Q is the volume flow rate in ft$^3$/s and $\Delta p_T$ is the total pressure rise in lbf/ft$^2$ (including the axial flow velocity pressure).

The Diffusion Factor, or the velocity ratio is thus written as $$D_p=1-V_2/V_p=1-[1-\psi_T/2\sigma x\eta_T]/[x^2+\Phi^2)^{1/2}+\psi T/(4\rho x\eta_t)$$

The value of Dp is a traditional measure of blade loading and a design criterion for sizing the blade row solidity, $\sigma=N_BC/(2\pi\ r)$. $N_B$ is the number of blades, C is the blade chord and r is the blade radial station. $\eta_T$ is the fan efficiency based on total pressure rise.

The diffusion factor provides an upper limit on pressure rise at a given speed size and flow rate, since a blade row is prone to stall at values of $Dp \approx 0.55$. In practice, blade design and stall margin concerns require $D_p$ to be less than about 0.45. However, diffusion should be kept below the transition level for laminar flow. A suitable value is: $0.1 \leqq D_p \leqq 0.2$.

The amount of surface area which should be "roughened" to trip the laminar boundary layers is not obvious. Tests suggest that the roughness treatment should start at the blade tip at or near the trailing edges of the blades, since the highest peripheral speeds are at the blade tip. The influence of speed on the sound power level can be written as: $L_p=55\log_{10}V_T+\text{Constant}$. The value at x=r/R<1.0 becomes $\Delta L_p=55\log_{10}x$. The blade needs to be treated up to the point where a noise signature is negligibly small, perhaps a reduction of 10 dB. This implies a minimum value of x given by $x=10^{-(10/55)}=0.66$. Tests on a 12.0 inch radius fan confirmed the relationship of tonal sound power and tonal frequency to several x locations of boundary layer trips. If a 5 dB reduction in emissions is the criterion, then the roughness should extend to about x=0.8 or about 3.0 inches in toward the hub, for example, on a 12.0 inch radius fan.

The extent of roughness needed in the chord-wise direction is not as clearly defined. The hypothesis that laminar flow exists all the way to the trailing edge in the absence of added roughness suggests that the coherent vortex shedding can be prevented with the roughness added to the blade surface exactly at or directly adjacent to the trailing edge and extending over at least about three percent of the blade chordwise length.

Figure 13:
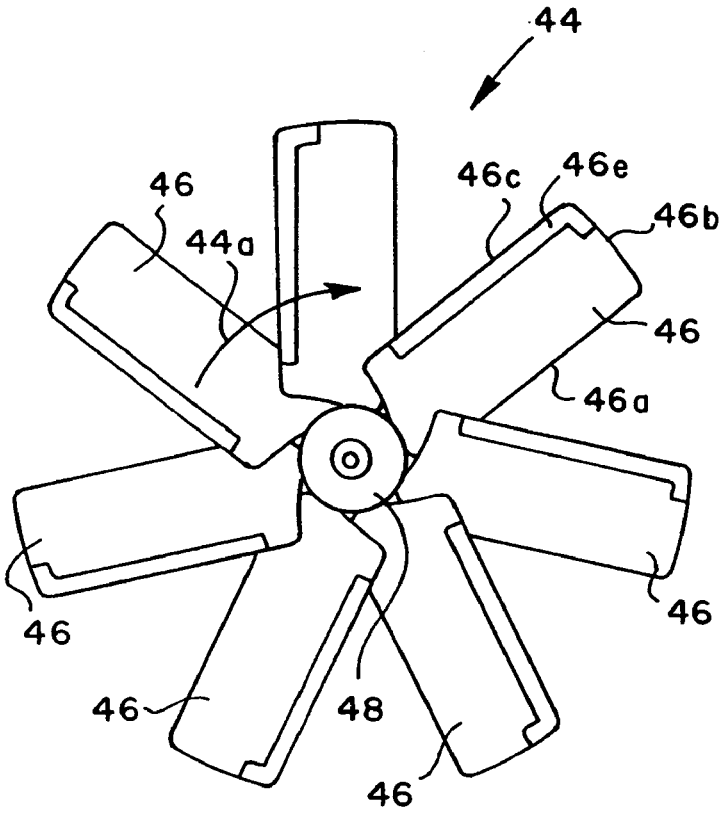
FIG. 13 is a plan view of a fan propeller having substantially straight, radial blades and including the improvement of the present invention.

Referring briefly to FIG. 13, there is illustrated an embodiment of a fan propeller in accordance with the invention and generally designated by the numeral 44. The axial flow fan propeller 44 includes plural, circumferentially spaced substantially straight radial blades 46 each, suitably connected to a hub 48. Each blade 46 includes a leading edge 46*a*, a peripheral rim or tip 46*b* and a trailing edge 46*c*. The direction of rotation of the propeller fan 44 is indicated at arrow 44*a*. The trailing edge 46*c* of each blade 46 is provided with a roughened surface portion 46*e*on the blade surface which may be characterized as to its roughness in the same manner as for the fan propeller 24.

Figure 14:
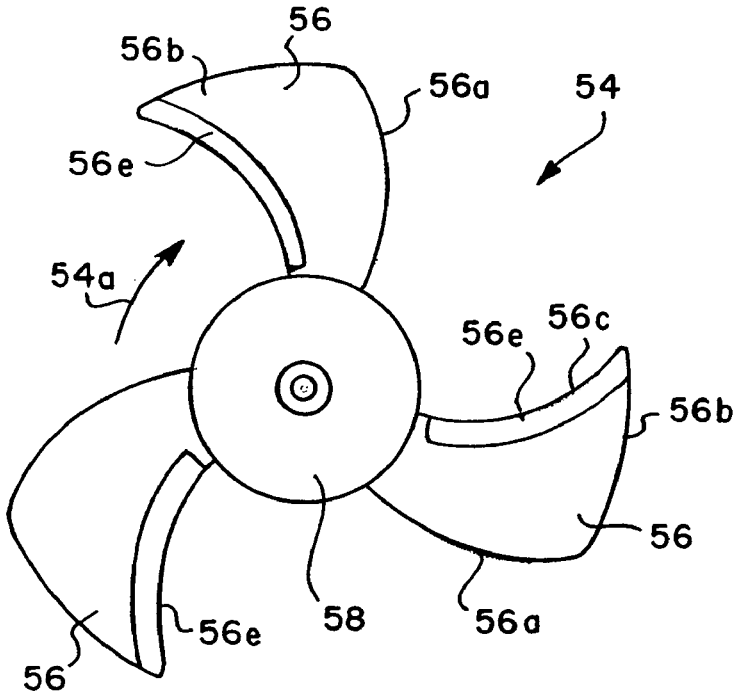
FIG. 14 is a plan view of a fan propeller with backward-swept blades and including a roughened area along the trailing edges of the blades, respectively.

Referring to FIG. 14, there is illustrated another embodiment of a fan propeller in accordance with the invention and generally designated by the numeral 54. Fan propeller 54 includes plural circumferentially spaced, backward-swept blades 56, each having a leading edge 56*a*, a peripheral rim or tip 56*b* and a trailing edge 56*c*. Each propeller blade 56 is suitably connected to a central hub 58. Each propeller blade 56 is also provided with a roughened surface 56*e*on the blade surface, disposed along the trailing edge 56*c* and characterized generally in the same manner as the roughened surfaces of the blades of fan propellers 24 and 44. Rotation is in the direction of arrow 54*a*.

Fabrication of the fan propellers 24, 44 and 54 may be carried out using conventional manufacturing processes known to those skilled in the art of air-moving fans and as reinforced by the description hereinbefore. Conventional engineering materials may be used for fabricating the propeller fans 24, 44 and 54.

Although preferred embodiments of the invention have been described in detail herein, those skilled in the art will recognize that various substitutions and modifications may be made without departing from the scope and spirit of the appended claims.

What is claimed is:

1. An air moving fan propeller having a hub and plural circumferentially spaced blades, each of said blades having a leading edge, a peripheral rim or tip and a trailing edge with respect to the direction of rotation, at least selected ones of said blades including a portion formed on a pressure side surface thereof, respectively, disposed adjacent said trailing edge of said selected ones of said blades, respectively, and extending generally from said peripheral tip inwardly toward said hub along said trailing edge and including projections extending into a boundary layer of air flowing over said surface of said blades, respectively, said projections extending over a major portion of said trailing edge of said blades, respectively, and from said trailing edge of said blades over at least 3% of the chordwise length of said blades, respectively, said projections being formed by plural, generally parallel alternate grooves and corresponding upturned sharp edges having a height above said surface at least equal to the thickness of said boundary layer, said thickness of said boundary layer being definable as $(1.721 \cdot X)/R_e^{1/2}$ wherein $R_e$ is the Reynolds number and X is the chordwise position on said blade from said leading edge, and said grooves and said sharp edges are formed by skiving said blades, respectively, and said grooves and said sharp edges extend along and substantially parallel to said trailing edge.

* * * * *